US008046234B2

(12) United States Patent
Kim et al.

(10) Patent No.: US 8,046,234 B2
(45) Date of Patent: Oct. 25, 2011

(54) METHOD AND APPARATUS FOR ENCODING/DECODING AUDIO DATA WITH SCALABILITY

(75) Inventors: Jung-hoe Kim, Seoul (KR); Sang-wook Kim, Seoul (KR); Eun-mi Oh, Seoul (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 986 days.

(21) Appl. No.: 10/735,894

(22) Filed: Dec. 16, 2003

(65) Prior Publication Data

US 2004/0181394 A1 Sep. 16, 2004

(30) Foreign Application Priority Data

Dec. 16, 2002 (KR) ..... 10-2002-0080320

(51) Int. Cl.
*G10L 19/00* (2006.01)

(52) U.S. Cl. ..... 704/500; 704/200; 704/200.1; 704/201; 704/501

(58) Field of Classification Search ..... 704/500, 704/501, 200–201
See application file for complete search history.

(56) References Cited

U.S. PATENT DOCUMENTS

| | | | | |
|---|---|---|---|---|
| 6,094,636 | A | 7/2000 | Kim | |
| 6,438,525 | B1 * | 8/2002 | Park | 704/500 |
| 6,502,069 | B1 | 12/2002 | Grill et al. | |
| 6,529,604 | B1 | 3/2003 | Park et al. | |
| 2002/0131084 | A1 * | 9/2002 | Andrew et al. | 358/1.16 |

FOREIGN PATENT DOCUMENTS

| | | | |
|---|---|---|---|
| CN | 1218334 | A | 6/1999 |
| EP | 0 918 407 | A | 5/1999 |
| JP | 10-285042 | A | 10/1998 |
| JP | 11-317672 | A | 11/1999 |
| JP | 1999-317672 | | 11/1999 |

(Continued)

OTHER PUBLICATIONS

Sung-Hee Park et al., "Multi-Layer Bit-Sliced Bit-Rate Scalable Audio Coding", preprints of papers presented at the AES Convention, vol. 103, 16 pages, Dec. 12, 1997.

(Continued)

*Primary Examiner* — Richemond Dorvil
*Assistant Examiner* — Douglas Godbold
(74) *Attorney, Agent, or Firm* — Staas & Halsey LLP

(57) ABSTRACT

Method and apparatus for encoding/decoding audio data with scalability are provided. The method includes slicing audio data so that sliced audio data corresponds to a plurality of layers, obtaining scale band information and coding band information corresponding to each of the plurality of layers, coding additional information containing scale factor information and coding model information based on scale band information and coding band information corresponding to a first layer, obtaining quantized samples by quantizing audio data corresponding to the first layer with reference to the scale factor information, coding the obtained plurality of quantized samples in units of symbols in order from a symbol formed with most significant bits (MSB) down to a symbol formed with least significant bits (LSB) by referring to the coding model information, and repeatedly performing the steps with increasing the ordinal number of the layer one by one every time, until coding for the plurality of layers is finished. According to the method, fine grain scalability (FGS) can be provided with a lower complexity and a better audio quality can be provided even in a lower layer.

7 Claims, 8 Drawing Sheets

FOREIGN PATENT DOCUMENTS

| | | | |
|---|---|---|---|
| JP | 2001-134294 | A | 5/2001 |
| JP | 2001-318684 | A | 11/2001 |
| JP | 2001-522156 | A | 11/2001 |
| JP | 2002-156998 | | 5/2002 |
| JP | 2002-156998 | A | 5/2002 |
| KR | P1998-079475 | | 11/1997 |

OTHER PUBLICATIONS

Sang-Wook Kim et al., "ISO/IEC 14496-3 (MPEG-4 Audio) Amd. 1 FPDAM Annex A (informative)", ISO/IEC JTC1/SC29/WG11 N2803, Jul. 1999, Vancouver, Canada, pp. 1-53, XP002273900, Retrieved from the Internet:URL:ftp://ftp.tnt.uni-hannover.de/pub/MPEG/audio/mpeg4/documents/w2803/w2803_ i.pdf retrieved on Mar. 12, 2004, p. 12, paragraph A.2.2—p. 13, paragraph A.2.3.

W. Kurt Dobson et al., "High Quality Low Complexity Scalable Wavelet Audio Coding" Acoustics, Speech, and Signal Processing, 1997 IEEE International Conference in Munich, Germany, Apr. 21-24, 1997, Los Alamitos, CA, USA, IEEE Comput. Soc, US, Apr. 21, 1997, pp. 327-330.

Korean Office Action issued Jan. 23, 2009, for corresponding KR Application No. 10-2002-0080320.

Japanese Office Action issued Jan. 4, 2006.

Office Action dated Nov. 28, 2008 issued in Chinese Patent Application No. 03165035X.

English Translation of Office Action dated Nov. 28, 2008 issued in Chinese Patent Application No. 03165035X.

* cited by examiner

METHOD AND APPARATUS FOR ENCODING/DECODING AUDIO DATA WITH SCALABILITY

This application claims the priority of Korean Patent Application No. 2002-80320, filed Dec. 16, 2002, in the Korean Intellectual Property Office, the disclosure of which is incorporated herein in its entirety by reference.

BACKGROUND OF THE INVENTION

1. Field of the Invention

The present invention relates to coding and decoding audio data, and more particularly, to a method and apparatus for coding audio data so that a coded audio bitstream has a scalable bitrate, and a method and apparatus for decoding the audio data.

2. Description of the Related Art

Due to recent developments in digital signal processing technology, audio signals are generally stored in most cases as digital data and reproduced. Digital audio storage/restoration apparatuses transform audio signals into pulse code modulation (PCM) audio data, i.e., digital signals, through sampling and quantization. By doing so, the digital audio storage/reproducing apparatus stores the PCM audio data in an information storage medium such as a compact disc (CD) and a digital versatile disc (DVD), and reproduces the stored signal in response to a user's command such that the user can listen to the audio data. The digital storage/restoration method greatly improves audio quality compared to analog methods using a long-playing (LP) record or magnetic tape, and dramatically reduces deterioration caused by a long storage period. However, the digital method has a problem in storage and transmission due to the large amount of digital data.

To solve this problem, a variety of compression methods are used to compress digital audio signals.

In Moving Pictures Expert Group (MPEG)/audio standardized by International Standard Organization (ISO), or AC-2/AC-3 developed by Dolby, the amount of data is reduced using psychoacoustic models. As a result, the amount of data can be efficiently reduced regardless of the characteristics of a signal. That is, the MPEG/audio standard or AC-2/AC-3 method can provide almost the same audio quality as that of a CD with a bitrate of only 64~384 Kbps, which is ⅙ to ⅛ of that of the previous digital encoding method.

In these methods, however, an optimal state suitable for a fixed bitrate is searched for and then quantization and encoding are performed. Accordingly, if the transmission bandwidth is lowered due to poor network conditions in transmitting bitstreams through the network, cut-offs may occur and appropriate services cannot be rendered to a user any more. In addition, when the bitstream is desired to be transformed into bitstreams of a smaller size more suitable for a mobile apparatus having a limited storage capacity, a re-encoding process should be performed in order to reduce the size of a bitstream, and the amount of computation required increases.

To solve this problem, the applicant of the present invention filed Korea Patent Application No. 97-61298 on Nov. 19, 1997 entitled "Bitrate Scalable Audio Encoding/Decoding Method and Apparatus Using Bit-Sliced Arithmetic Coding (BSAC)", for which a patent was granted on Apr. 17, 2000 with Korea Patent No. 261253. According to the BSAC technique, a bitstream coded with a high bitrate can be made into a bitstream with a low bitrate, and restoration is possible with only part of the bitstream. Accordingly, when the network is overloaded, or the performance of a decoder is poor, or a user requests a low bitrate, services with some degree of audio quality can be provided to the user by using only part of the bitstream, though the quality will inevitably decrease in proportion to the decrease in the bitrate.

However, since the BSAC technique adopts arithmetic coding, complexity is high, and when the BSAC technique is implemented in an actual apparatus, the cost increases. In addition, since the BSAC technique uses a modified discrete cosine transform (MDCT) for transformation of an audio signal, audio quality in a lower layer may severely deteriorate.

SUMMARY OF THE INVENTION

The present invention provides a method and apparatus for encoding/decoding audio data with scalability, by which fine grain scalability (FGS) is provided with lower complexity.

According to an aspect of the present invention, there is provided a method for coding audio data with scalability slicing audio data so that sliced audio data corresponds to a plurality of layers, obtaining scale band information and coding band information corresponding to each of the plurality of layers, coding additional information containing scale factor information and coding model information based on scale band information and coding band information corresponding to a first layer, obtaining quantized samples by quantizing audio data corresponding to the first layer with reference to the scale factor information, coding the obtained plurality of quantized samples in units of symbols in order from a symbol formed with most significant bits (MSB) down to a symbol formed with least significant bits (LSB) by referring to the coding model information, and repeatedly performing the steps with increasing the ordinal number of the layer one by one every time, until coding for the plurality of layers is finished.

Before the coding of additional information, there may be further included obtaining a bit range allowed in each of the plurality of layers, wherein in the coding of the obtained plurality of quantized samples, the number of coded bits is counted, and if the number of counted bits exceeds a bit range corresponding to the bits, coding is stopped, and if the number of counted bits is less than the bit range corresponding to the bits even after quantized samples are all coded, bits that remain not coded after coding in a lower layer is finished are coded to the extent that the bit range permits.

The slicing of audio data comprises performing a wavelet transform of audio data, and slicing the wavelet-transformed data by referring to a cut-off frequency so that the sliced data corresponds to the plurality of layers.

The coding of the plurality of quantized samples comprises mapping a plurality of quantized samples on a bit plane, and coding the samples in units of symbols within a bit range allowed in a layer corresponding to the samples in order from a symbol formed with MSB bits down to a symbol formed with LSB bits. In the mapping of the plurality of quantized samples, K quantized samples are mapped on a bit plane, and in the coding of the samples, a scalar value corresponding to the symbol formed with K-bit binary data is obtained, and Huffman coding is performed by referring to the K-bit binary data, the obtained scalar value, and a scalar value corresponding to a symbol higher than a current symbol on the bit plane, where K is an integer.

According to another aspect of the present invention, there is provided a coding method comprising differential-decoding additional information containing scale factor information and coding model information corresponding to a first layer, Huffman-decoding audio data in units of symbols in order from a symbol formed with MSB bits down to a symbol formed with LSB bits and obtaining quantized samples by referring to the coding model information, inversely quantizing the obtained quantized samples by referring to the scale factor information, inversely MDCT transforming the inversely quantized samples, and repeatedly performing the steps with increasing the ordinal number of the layer one by one every time, until decoding for a predetermined plurality of layers is finished.

The Huffman-decoding of audio data comprises decoding audio data in units of symbols within a bit range allowed in a layer corresponding to the audio data, in order from a symbol formed with MSB bits down to a symbol formed with LSB bits, and obtaining quantized samples from a bit plane on which decoded symbols are arranged.

In decoding audio data, a 4*K bit plane formed with decoded symbols is obtained, and in obtaining quantized samples, K quantized samples are obtained from the 4*K bit plane, where K is an integer.

According to another aspect of the present invention, there is provided an apparatus for decoding audio data that is coded in a layered structure, with scalability, comprising an unpacking unit which decodes additional information containing scale factor information and coding model information corresponding to a first layer, and by referring to the coding model information, decodes audio data in units of symbols in order from a symbol formed with MSB bits down to a symbol formed with LSB bits and obtaining quantized samples, an inverse quantization unit which inversely quantizes the obtained quantized samples by referring to the scale factor information, and an inverse transformation unit which inverse-transforms the inversely quantized samples.

The unpacking unit decodes audio data in units of symbols within a bit range allowed in a layer corresponding to the audio data, in order from a symbol formed with MSB bits down to a symbol formed with LSB bits, and obtains quantized samples from a bit plane on which decoded symbols are arranged.

The unpacking unit obtains a 4*K bit plane formed with decoded symbols and then, obtains K quantized samples from the 4*K bit plane, where K is an integer.

According to another aspect of the present invention, there is provided an apparatus for coding audio data with scalability comprising a transformation unit which MDCT transforms the audio data, a quantization unit which quantizes the MDCT-transformed audio data corresponding to each layer, by referring to the scale factor information, and outputs quantized samples, and a packing unit which differential-codes additional information containing scale factor information and coding model information corresponding to each layer, and Huffman-codes the plurality of quantized samples from the quantization unit, in units of symbols in order from a symbol formed with most significant bits (MSB) down to a symbol formed with least significant bits (LSB) by referring to the coding model information.

The packing unit obtains scale band information and coding band information corresponding to each of the plurality of layers, and codes additional information containing scale factor information and coding model information based on scale band information and coding band information corresponding to each layer.

The packing unit counts the number of coded bits and if the number of counted bits exceeds a bit range corresponding to the bits, stops the coding, and if the number of counted bits is less than the bit range corresponding to the bits even after quantized samples are all coded, codes bits that remain not coded after coding in a lower layer is finished, to the extent that the bit range permits.

The packing unit slices the MDCT-transformed data by referring to a cut-off frequency so that the sliced data corresponds to the plurality of layers.

The packing unit maps a plurality of quantized samples on a bit plane, and codes the samples in units of symbols within a bit range allowed in a layer corresponding to the samples, in order from a symbol formed with MSB bits down to a symbol formed with LSB bits.

The packing unit maps K quantized samples on a bit plane, obtains a scalar value corresponding to the symbol formed with K-bit binary data, and then performs Huffman-coding by referring to the K-bit binary data, the obtained scalar value, and a scalar value corresponding to a symbol higher than a current symbol on the bit plane, where K is an integer.

BRIEF DESCRIPTION OF THE DRAWINGS

The above objects and advantages of the present invention will become more apparent by describing in detail preferred embodiments thereof with reference to the attached drawings in which.

DESCRIPTION OF THE PREFERRED EMBODIMENTS

Figure 1:
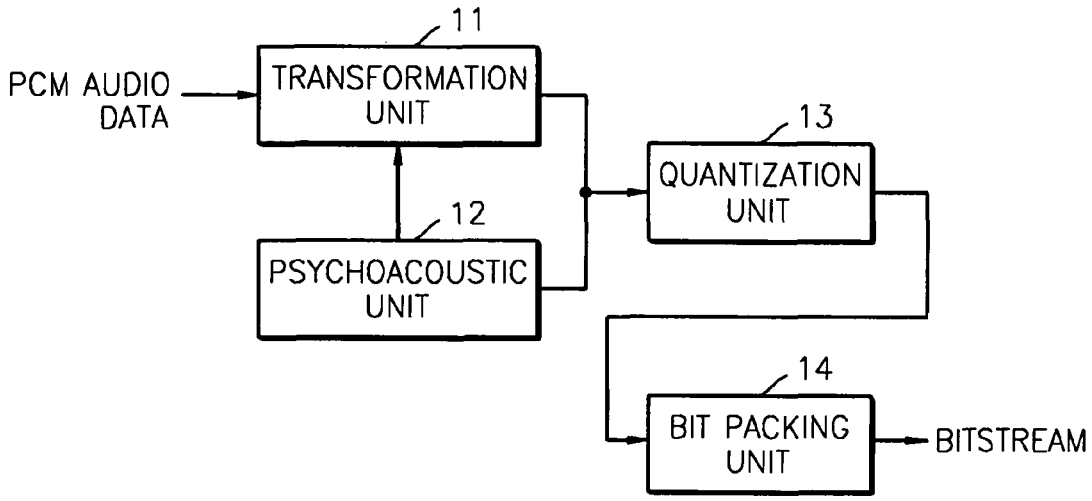
FIG. 1 is a block diagram of an encoding apparatus according to a preferred embodiment of the present invention.

Referring to FIG. 1, an encoding apparatus codes audio data in a layered structure so that the bitrate of the coded bitstream can be controlled according to the present invention, and comprises a transformation unit 11, a psychoacoustic unit 12, a quantization unit 13, and a bit packing unit 14.

The transformation unit 11 receives pulse code modulation (PCM) audio data which is a time domain audio signal, and transforms the signal into a frequency domain signal, referring to information on a psychoacoustic model provided by the psychoacoustic unit 12. While the differences between the characteristics of audio signals that a human being can perceive is not so big in the time domain, there is a big difference between the characteristics of a signal that can be perceived by a human and a signal that cannot be perceived by a human in the frequency domain audio signals obtained through transformation. Accordingly, by differentiating the numbers of bits allocated to respective frequency bands, the efficiency of compression can be increased. In the present embodiment, the transformation unit 11 performs a modified discrete cosine transform (MDCT).

The psychoacoustic unit 12 provides information on a psychoacoustic model such as attack sensing information, to the transformation unit 11 and groups the audio signals transformed by the transformation unit 11 into signals of appropriate subbands. Also, the psychoacoustic unit 12 calculates a masking threshold in each subband by using a masking effect caused by interactions between respective signals, and provides the threshold values to the quantization unit 13. The masking threshold is the maximum size of a signal that cannot be perceived by a human due to the interaction between audio signals. In the present embodiment, the psychoacoustic unit 12 calculates masking thresholds of stereo components by using binaural masking level depression (BMLD).

The quantization unit 13 scalar-quantizes an audio signal in each band, based on scale factor information corresponding to the audio signal, so that the size of quantization noise in the band is less than the masking threshold provided by the psychoacoustic unit 12 so that a human cannot perceive the noise. Then, the quantization unit 13 outputs the quantized samples. That is, by using the masking threshold calculated in the psychoacoustic unit 12 and a noise-to-mask ratio (NMR) that is the ratio of a noise generated in each band, the quantization unit 13 performs quantization so that NMR values are 0 dB or less in the entire bands. The NMR values of 0 dB or less mean that a human cannot perceive the quantization noise.

The bit packing unit 14 codes quantized samples belonging to each layer and additional information and packs the coded signal in a layered structure. The additional information includes scale band information, coding band information, their scale factor information, and coding model information in each layer. The scale band information and coding band information may be packed as header information and then transmitted to a decoding apparatus. Otherwise, the scale band information and coding band information may be coded and packed as additional information for each layer and then transmitted to a decoding apparatus. The scale band information and coding band information may not be transmitted to a decoding apparatus because they are pre-stored in the decoding apparatus in some cases.

More specifically, while coding additional information containing scale factor information and coding model information corresponding to a first layer, the bit packing unit 14 performs coding of the samples and information in units of symbols in order from a symbol formed with most significant bits (MSBs) down to a symbol formed with least significant bits (LSBs), referring to coding model information corresponding to the first layer. Then, in the second layer, the same process is repeatedly performed. That is, until the coding of a plurality of predetermined layers is finished, coding is performed with increasing the number of layers. In the present embodiment, the bit packing unit 14 differential-codes the scale factor information and the coding model information, and Huffman-codes the quantized samples. The layered structure of bitstreams coded according to the present invention will be explained later.

Scale band information refers to information for performing quantization more appropriately according to frequency characteristics of an audio signal. When a frequency area is divided into a plurality of bands and an appropriate scale factor is allocated to each band, the scale band information indicates a scale band corresponding to each layer. Thus, each layer belongs to at least one scale band. Each scale band has one allocated scale factor. Also, coding band information refers information for performing coding more appropriately according to frequency characteristics of an audio signal. When a frequency area is divided into a plurality of bands and an appropriate coding model is assigned to each band, the coding band information indicates a coding band corresponding to each layer. The scale bands and coding bands are empirically divided, and scale factors and coding models corresponding thereto, respectively, are determined based on the same.

Figure 2:
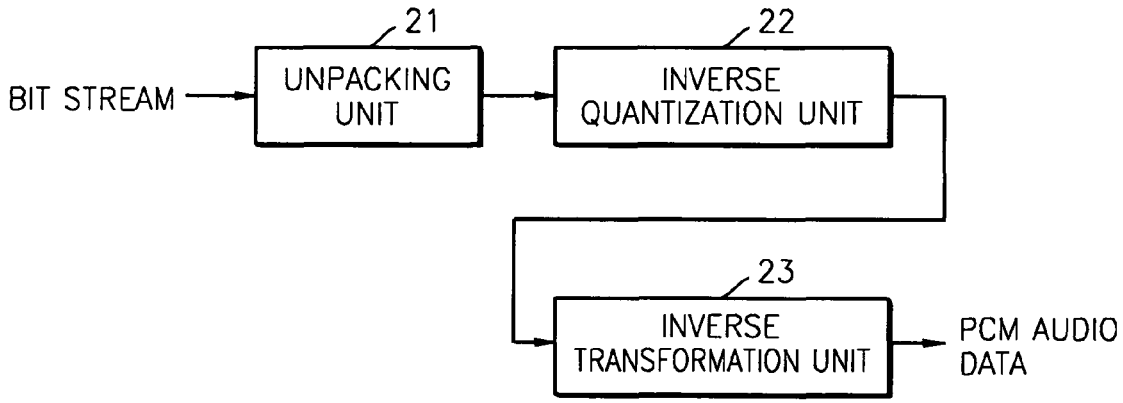
FIG. 2 is a block diagram of a decoding apparatus according to a preferred embodiment of the present invention.

FIG. 2 is a block diagram of a decoding apparatus according to a preferred embodiment of the present invention.

Referring to FIG. 2, the decoding apparatus decodes bitstreams to a target layer determined by the condition of a network, the performance of the decoding apparatus, and a user's selection such that the bitrate of a bitstream can be controlled. The decoding apparatus comprises an unpacking unit 21, an inverse quantization unit 22, and an inverse transformation unit 23.

The unpacking unit 21 unpacks bitstreams to a target layer, and decodes bitstreams in each layer. That is, additional information containing scale factor information and coding model information corresponding to each layer is decoded, and then based on the obtained coding model information, coded quantized samples belonging to the layer are decoded and the quantized samples are restored. In the present embodiment, the unpacking unit 21 differential-decodes scale factor information and coding model information and Huffman-decodes the coded quantized samples.

Meanwhile, the scale band information and coding band information are obtained from the header information of a bitstream or by decoding additional information in each layer. Alternatively, the decoding apparatus may store the scale band information and coding band information in advance. The inverse quantization unit 22 inversely quantizes and restores quantized samples in each layer according to scale factor information corresponding to the samples. The inverse transformation unit 23 frequency/time-maps the restored samples to transform the samples into PCM audio data of a time domain, and outputs the same. In the present embodiment, the inverse transformation unit 23 performs MDCT-based inverse transformation.

Figure 3:
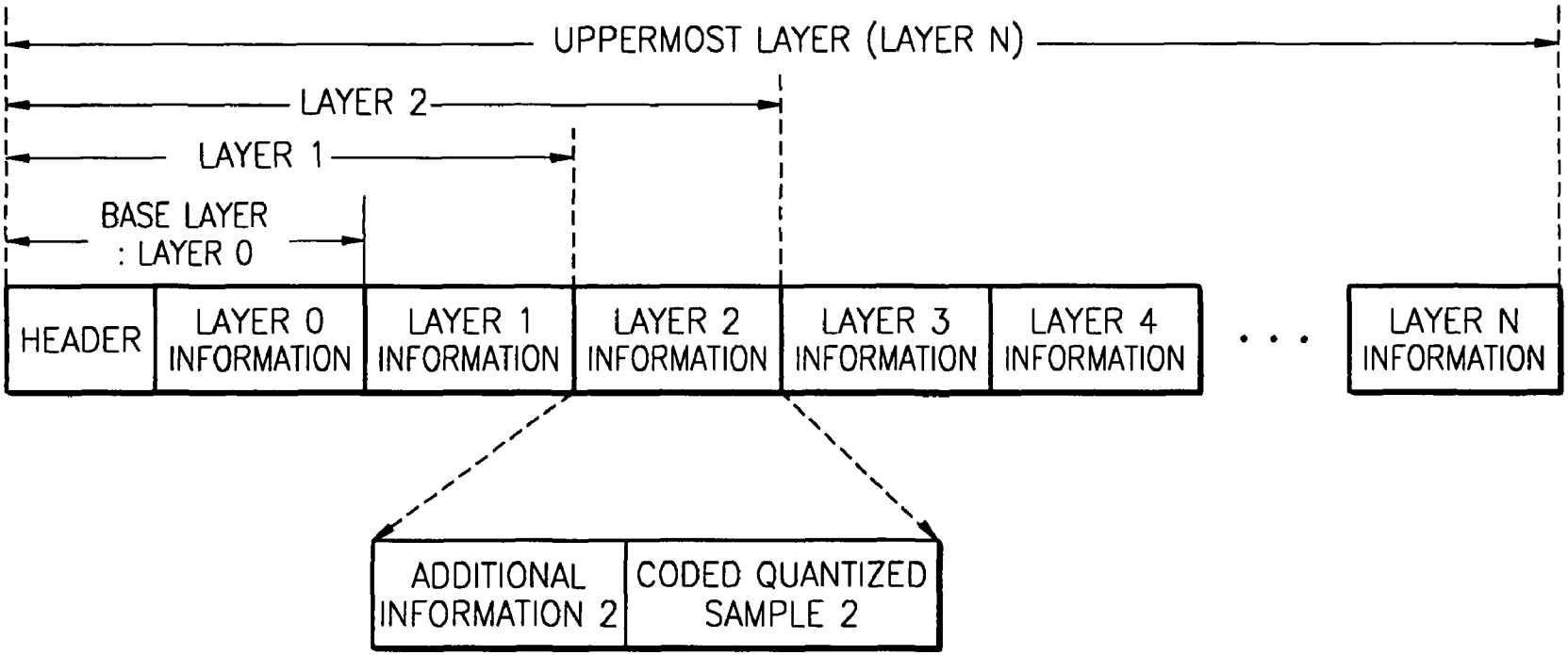
FIG. 3 is a diagram of the structure of a frame which forms a bitstream coded in a layered structure so that so that the bitrate can be controlled.

FIG. 3 is a diagram of the structure of a frame which forms a bitstream coded in a layered structure so that the bitrate can be controlled.

Referring to FIG. 3, the frame of a bitstream according to the present invention is coded by mapping quantized samples and additional information to a layered structure in order to obtain fine grain scalability (FGS). In other words, a lower layer bitstream is included in an enhancement layer bitstream in the layered structure. Additional information needed in each layer is allocated to each layer and then coded.

A header region for storing header information is placed in the front of a bitstream, then information on layer 0 is packed after the header region, and then information belonging to layers 1 through N that are enhancement layers are packed in order. A layer from the header region to layer 0 information is referred to as base layer, a layer from the header region to layer 1 information is referred to as layer 1, and a layer from the header region to layer 2 information is referred to as layer 2. Likewise, an uppermost layer indicates a layer from the header region to layer N information, that is, from the base layer to layer N that is the enhancement layer. Additional information and coded audio data are stored as each layer information. For example, additional information 2 and coded quantized samples are stored as layer 2 information. Here, N is an integer greater than or equal to 1.

Figure 4:
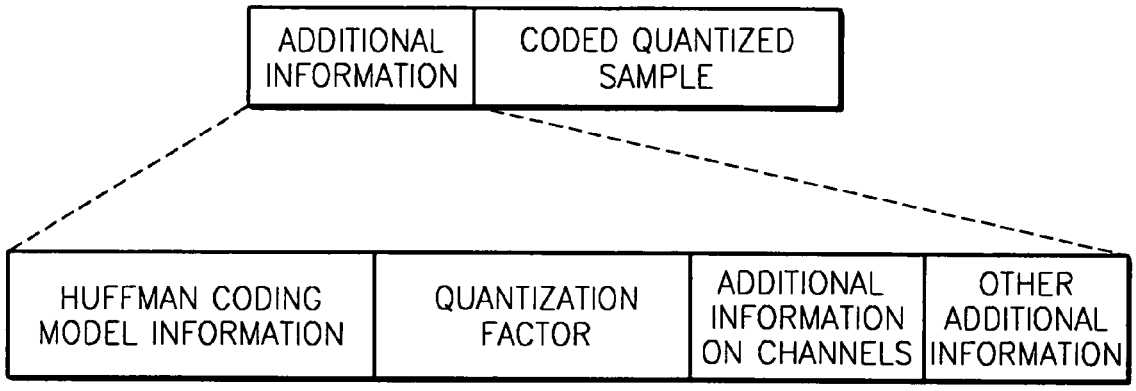
FIG. 4 is a detailed diagram of the structure of additional information.

FIG. 4 is a detailed diagram of the structure of additional information.

Referring to FIG. 4, additional information and coded quantized samples are stored as arbitrary additional information, and in the present embodiment, additional information includes Huffman coding model information, quantization factor information, additional information on channels, and other additional information. The Huffman coding model information is index information on a Huffman coding model which should be used in coding or decoding quantized samples belonging to a layer corresponding to the information. Quantization factor information indicates a quantization step size for quantizing or inversely quantizing audio data belonging to a layer corresponding to the information. Additional information on channels is information on a channel such as M/S stereo. Other additional information is flag information on whether M/S stereo is employed or not.

In the present embodiment, the bit packing unit 14 performs differential coding of Huffman coding model information and quantization factor information. In the differential coding, the differential value of a value of an immediately previous band is coded. Additional information on channels is Huffman-coded.

Figure 5:
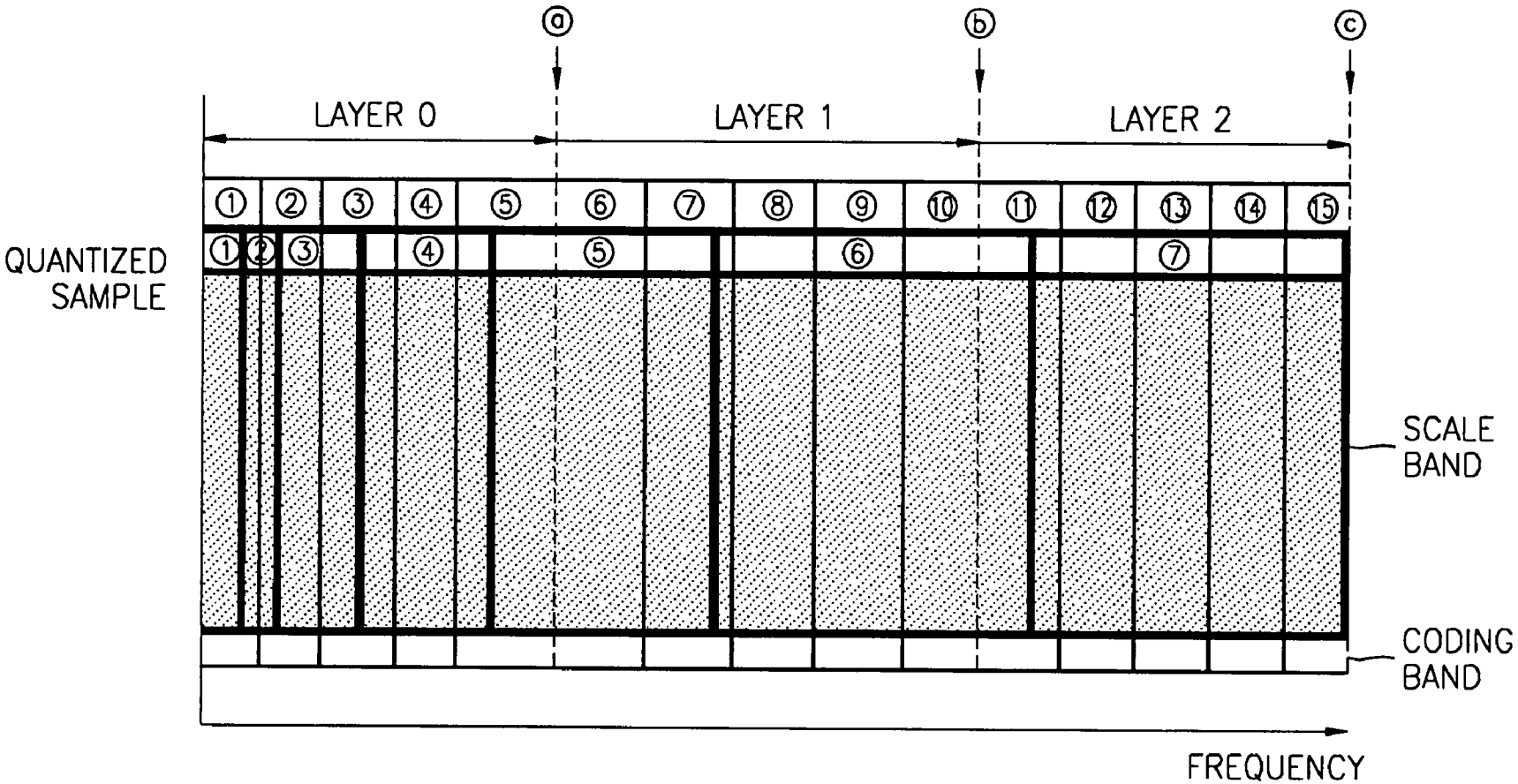
FIG. 5 is a reference diagram to explain schematically an encoding method according to the present invention.

FIG. 5 is a reference diagram to explain more specifically an encoding method according to the present invention.

Referring to FIG. 5, quantized samples to be coded have a 3-layered structure. An oblique lined rectangle denotes a spectral line composed of quantized samples, solid lines indicate scale bands and dotted lines indicate coding bands. Scale bands ①, ②, ③, ④ and ⑤ and coding bands ①, ②, ③, ④ and ⑤ belong to layer 0. Scale bands ⑤ and ⑥ and coding bands ⑥, ⑦, ⑧, ⑨ and ⑩ belong to layer 1. Scale bands ⑥ and ⑦ and coding bands ⑪, ⑫, ⑬, ⑭ and ⑮ belong to layer 2. Meanwhile, layer 0 is defined such that coding is performed up to a frequency band ⓐ, layer 1 is defined such that coding is performed up to a frequency band ⓑ and layer 2 is defined such that coding is performed up to a frequency band ⓒ.

First, quantized samples belonging to layer 0 are coded within a bit range of 100 using the corresponding coding model. Also, as additional information of layer 0, the scale bands ①, ②, ③, ④ and ⑤ and coding bands ①, ②, ③, ④ and ⑤ belonging to layer 0 are coded. While coding the quantized samples in units of symbols, the number of bits are counted. If the number of bits counted exceeds the allowed bit range, coding of layer 0 is stopped and layer 1 is arithmetic-coded. Among the quantized samples belonging to layer 0, uncoded quantized samples are coded next when there is still room in the number of allowed bits in layers 0 and 1.

Next, quantized samples belonging to layer 1 are coded using a coding model of one among coding bands belonging to layer 1, that is, the coding bands ⑥, ⑦, ⑧, ⑨ and ⑩, to which quantized samples to be coded belong. Also, as additional information of layer 1, the scale bands ⑤ and ⑥ and coding bands ⑥, ⑦, ⑧, ⑨ and ⑩ belonging to layer 1 are coded. If there is still room in the allowed bit range, that is, 100 bits, even after coding all samples corresponding to layer 1, uncoded bits remaining in layer 0 are coded until the allowed bits, that is, 100 bits, are counted. If the number of bits counted for coding exceeds the allowed bit range, coding of layer 1 is stopped and coding of layer 2 is started.

Finally, quantized samples belonging to layer 2 are coded using a coding model of one among coding bands belonging to layer 2, that is, the coding bands ⑪, ⑫, ⑬, ⑭ and ⑮, to which quantized samples to be coded belong. Also, as additional information of layer 2, the scale bands ⑥ and ⑦ and coding bands ⑪, ⑫, ⑬, ⑭ and ⑮ belong to layer 2 are coded. If there is still room in the allowed bit range, that is, 100 bits, even after coding all samples corresponding to layer 2, uncoded bits remaining in layer 0 are coded until the allowed bits, that is, 100 bits, are counted.

If all the quantized samples are coded without consideration of an allowed bit range for layer 0, that is, if all the quantized samples are coded even after the number of coded bits exceeds the allowed bit range, that is, 100, which means that some of bits in an allowed bit range for the next layer, that is, layer 1, are used in coding the current layer, it is often the case that quantized samples belonging to layer 1 cannot be coded. Thus, in the case of scalable decoding, if decoding is performed on layers ranging up to layer 1, since all the quantized samples ranging up to a predetermined frequency band ⓑ corresponding to layer 1 are not coded, decoded quantized samples may fluctuate at frequencies lower than ⓑ, resulting in a "Birdy" effect in which audio quality may deteriorate.

In determining a plurality of layers (target layers), a bit range is assigned in consideration of the entire size of all audio data to be decoded. Thus, there is no possibility that coding is not performed due to a shortage in bit range in which bits to be coded are arranged.

While decoding is performed in the opposite manner to the coding process, the number of bits is counted according to the allowed bit range. Thus, a point of decoding timing of a predetermined layer can be identified.

Figure 6:
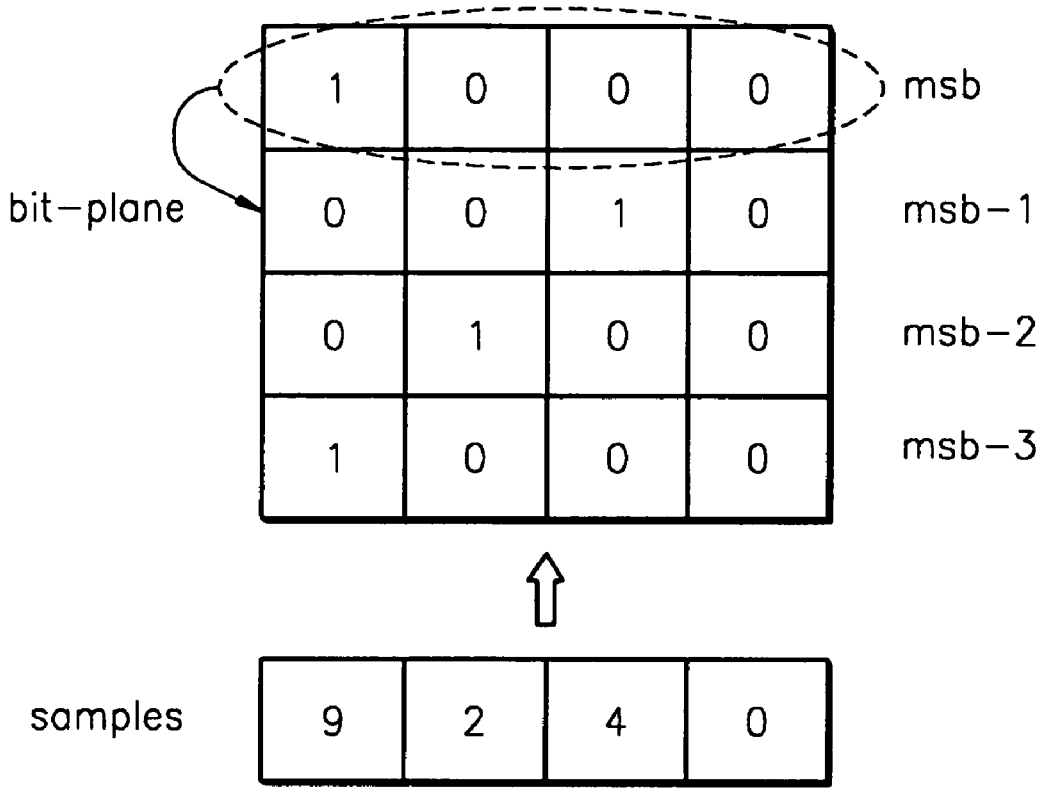
FIG. 6 is a reference diagram to explain more specifically an encoding method according to the present invention.

FIG. 6 is a reference diagram to explain more specifically an encoding method according to the present invention.

According to the present invention, the bit packing unit 14 performing coding on quantized samples corresponding to each layer by bit-plain coding and Huffman-coding. A plurality of quantized samples are mapped on a bit plane to then be expressed in binary form, and coded within an allowed bit range for each layer in order from a symbol formed with MSBs down to a symbol formed with LSBs. Important information on a bit plane is first coded, and relatively less important information is coded later. By doing so, a bitrate and a frequency band corresponding to each layer are fixed in the coding process so that distortion referred to as "a Birdy effect" can be reduced.

FIG. 6 illustrates an example of coding in the case where the number of bits of symbols consisting of MSBs is 4 or less. When quantized samples 9, 2, 4, and 0 are mapped on a bit plane, they are expressed in binary form, i.e., 1001b, 0010b, 0100b, and 0000b, respectively. That is, in the present embodiment, the size of a coding block which is a coding unit on a bit plane is 4*4.

A symbol formed with the MSBs, msb, is "1001b", a symbol formed with the next MSBs, msb-1, is "0010b", a symbol formed with the next MSBs, msb-2, is "0100b", and a symbol formed the LSBs, msb-3, is "1000b".

Huffman model information for Huffman coding, that is, a codebook index is as table 1:

TABLE 1

| Additional Information | Significance | Huffman Model |
|---|---|---|
| 0 | 0 | 0 |
| 1 | 1 | 1 |
| 2 | 1 | 2 |
| 3 | 2 | 3 |
| | | 4 |
| 4 | 2 | 5 |
| | | 6 |
| 5 | 3 | 7 |
| | | 8 |
| | | 9 |
| 6 | 3 | 10 |
| | | 11 |
| | | 12 |

TABLE 1-continued

| Additional Information | Significance | Huffman Model |
|---|---|---|
| 7 | 4 | 13 |
| | | 14 |
| | | 15 |
| | | 16 |
| 8 | 4 | 17 |
| | | 18 |
| | | 19 |
| | | 20 |
| 9 | 5 | * |
| 10 | 6 | * |
| 11 | 7 | * |
| 12 | 8 | * |
| 13 | 9 | * |
| 14 | 10 | * |
| 15 | 11 | * |
| 16 | 12 | * |
| 17 | 13 | * |
| 18 | 14 | * |
| * | * | * |

According to the table 1, two models exist even for an identical significance level (msb in the present embodiment). This is because two models are generated for quantized samples that show different distributions.

A process for coding the example of FIG. 6 according to the table 1 will now be explained in more detail.

In the case where the number of bits of a symbol is 4 or less, Huffman coding according to the present invention is shown as equation 1:

$$\text{Huffman code value}=\text{HuffmanCodebook[codebook index][higher bit plane][symbol]} \quad (1)$$

That is, Huffman coding uses 3 input variables, including a codebook index, a higher bit plane, and a symbol. The codebook index indicates a value obtained from the table 1, the higher bit plane indicates a symbol immediately above a symbol desired to be coded at present on a bit plane. The symbol indicates a symbol desired to be coded at present.

Since the msb of the Huffman model is 4 in the example of FIG. 6, 13-16 or 17-20 are selected. If additional information to be coded is 8, the codebook index of a symbol formed with msb bits is 16, the codebook index of a symbol formed with msb-1 bits is 15, the codebook index of a symbol formed with msb-2 bits is 14, and the codebook index of a symbol formed with msb-3 bits is 13.

Meanwhile, since the symbol formed with msb bits does not have data of a higher bit plane, if the value of the higher bit plane is 0, coding is performed with a code HuffmanCodebook[16][0b][1000b]. Since the higher bit plane of the symbol formed with msb-1 bits is 1000b, coding is performed with a code HuffmanCodebook[15][1000b][0010b]. Since the higher bit plane of the symbol formed with msb-2 bits is 0010b, coding is performed with a code HuffmanCodebook [14][0010b][0100b]. Since the higher bit plane of the symbol formed with msb-3 bits is 0100b, coding is performed with a code HuffmanCodebook[13][0100b][1000b].

The bit packing unit 14 counts the number of coded bits, compares the counted number with the number of bits allowed to be used in a layer, and if the counted number is greater than the allowed number, stops the coding. When room is allowed in the next layer, the remaining bits that are not coded are coded and put in the next layer. If there is still room in the number of allowed bits in the layer after quantized samples allocated to a corresponding layer are all coded, that is, if there is room in the layer, quantized samples that remain not coded after coding in the lower layer is finished are coded.

Meanwhile, if the number of bits of a symbol formed with msb's is greater than or equal to 5, a Huffman code value is determined using a location on the current bit plane. In other words, if the significance is greater than or equal to 5, there is little statistical difference in data on each bit plane, the data is Huffman-coded using the same Huffman model. That is, a Huffman mode exists per bit plane.

If the significance is greater than or equal to 5, that is, the number of bits of a symbol is greater than or equal to 5, Huffman coding of the present invention satisfies the equation 2:

$$\text{Huffman code}=20+\text{bpl} \quad 2$$

wherein 'bpl' indicates an index of a bit plane desired to be currently coded and is an integer greater than or equal to 1. A constant 20 is a value added for indicating that an index starts from 21 because the last index of Huffman models corresponding to additional number 8, as listed in Table 2, is 20. Therefore, additional information for a coding band simply indicates significance. In Table 2, Huffman models are determined according to the index of a bit plane desired to be currently coded.

TABLE 2

| Additional information | Significance | Huffman model |
|---|---|---|
| 9 | 5 | 21-25 |
| 10 | 6 | 21-26 |
| 11 | 7 | 21-27 |
| 12 | 8 | 21-28 |
| 13 | 9 | 21-29 |
| 14 | 10 | 21-30 |
| 15 | 11 | 21-31 |
| 16 | 12 | 21-32 |
| 17 | 13 | 21-33 |
| 18 | 14 | 21-34 |
| 19 | 15 | 21-35 |

For quantization factor information and Huffman model information in additional information, DPCM is performed on a coding band corresponding to the information. When quantization factor information is coded, the initial value of DPCM is expressed by 8 bits in the header information of a frame. The initial value of DPCM for Huffman model information is set to 0.

The differences between the coding method according to the present invention and the prior art BSAC technique are as follows. First, in the BSAC technique, coding is performed in units of bits, while coding is performed in units of symbols in the present invention. Secondly, in the BSAC technique, arithmetic coding is used, while Huffman coding is used in the present invention. The arithmetic coding provides a higher compression gain, but increases complexity and cost. Accordingly, in the present invention, data is coded not in units of bits but in units of symbols through the Huffman coding such that complexity and cost decreases.

In order to control a bitrate, that is, in order to apply scalability, a bitstream corresponding to one frame is cut off, considering the number of bits allowed to be used in each layer such that only with a small amount of data, decoding is possible. For example, if only a bitstream corresponding to 48 kbps is desired to be decoded, only 1048 bits of a bitstream are used such that decoded audio data corresponding to 48 kbps can be obtained.

The coding and decoding methods according to the present invention based on the structure described above will now be explained.

The coding apparatus reads PCM audio data, stores the data in a memory (not shown), and obtains masking thresholds and additional information from the stored PCM audio data through psychoacoustic modeling. Since the PCM audio data is a time domain signal, the PCM audio data is wavelet-transformed into a frequency domain signal. Then, the coding apparatus obtains quantized samples by quantizing the wavelet-transformed signal according to quantization band information and quantization factor information. As described above, the quantized samples are coded and packed through bit-sliced coding, symbol unit-based coding, and Huffman coding.

Figure 7:
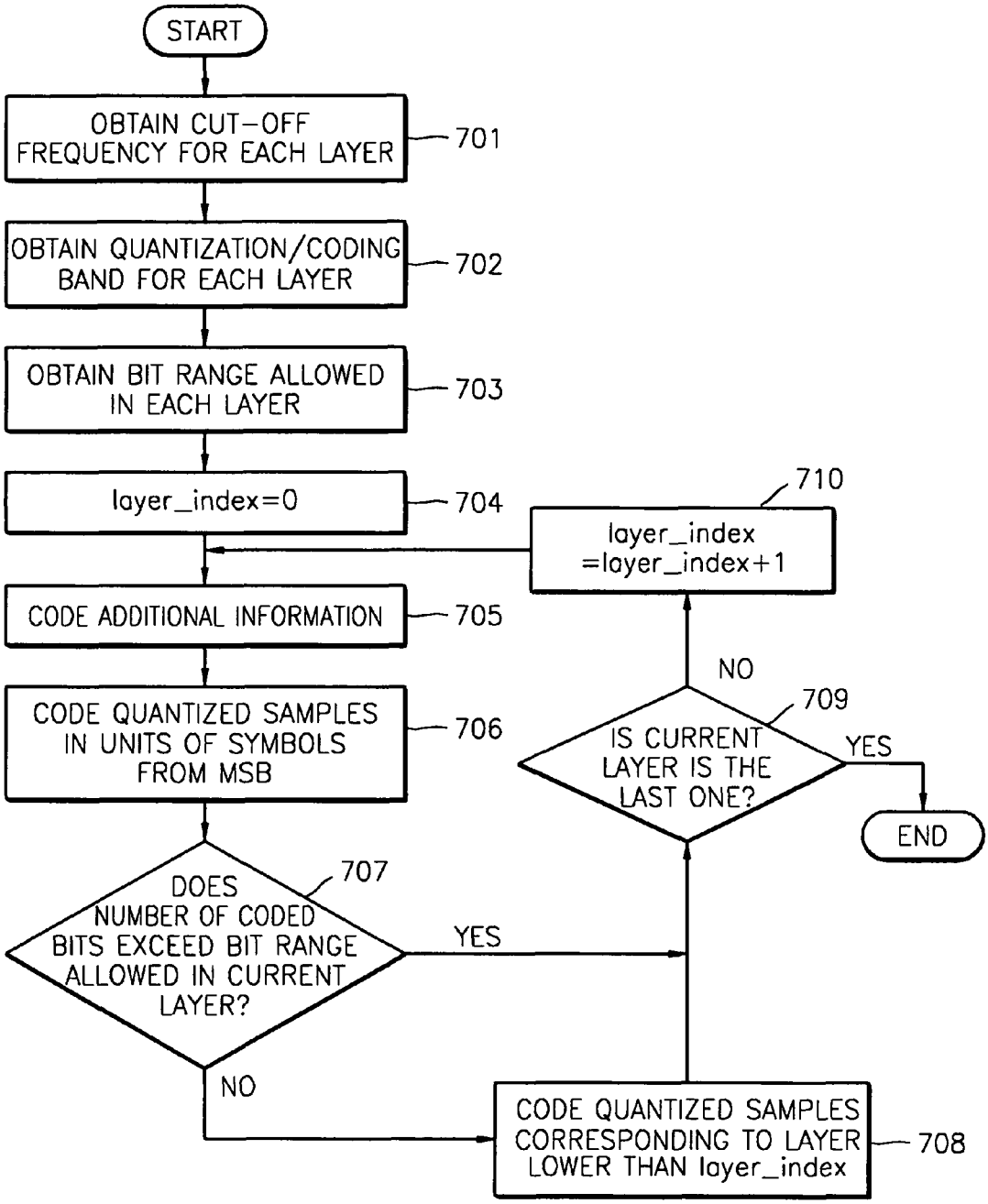
FIG. 7 is a flowchart for explaining an encoding method according to a preferred embodiment of the present invention.

FIG. 7 is a flowchart for explaining an encoding method according to a preferred embodiment of the present invention.

Referring to FIG. 7, the process in which the bit packing unit 14 of the coding apparatus codes and packs the quantized samples will now be explained.

First, the bit packing unit 14 extracts information corresponding to each layer, based on a provided target bitrate and additional information. This process is performed in steps 701 through 703. In detail, a cut-off frequency which is a base for cut-off in each layer is obtained in step 701, quantization band information and coding band information corresponding to each layer are obtained in step 702, and a bit range within which bits that should be coded can be coded in each layer is allocated in step 703.

Then, a layer index is determined as a base layer in step 704, and additional information, including quantization band information and coding band information, is coded in step 705.

Next, quantized samples corresponding to the base layer are mapped on a bit plane, and coded in units of 4*4 blocks from the symbol formed with msb bits in step 706. The number of coded bits is counted and if the number exceeds the bit range of the current layer in step 707, then coding in the current layer is stopped and coding begins in the next layer. If the counted number of bits does not exceed the bit range in step 707, the procedure goes back to step 705 for the next layer in step 709. Since the base layer has no lower layers, step 708 is not performed, but step 708 is performed for layers following after the base layer. Through the above steps, all layers ranging until the target layer is reached are coded.

Step 706, that is, step for coding quantized samples, is as follows:

1. Quantized samples corresponding to a layer are grouped in units of N samples and mapped on a bit plane.

2. Huffman coding is performed from a symbol formed with msb bits of mapped binary data Substep 2 can be explained in more detail as follows:

2.1 A scalar value (curVal) corresponding to a symbol desired to be coded is obtained.

2.2 A Huffman code corresponding to a scalar value (upperVal) which corresponds to a symbol in a higher bit plane, that is, a symbol that is in a higher location in the bitstream than the location of a symbol desired to be currently coded is obtained.

For quantization factor information and Huffman model information in additional information, DPCM is performed on a coding band corresponding to the information. When quantization factor information is coded, the initial value of DPCM is expressed by 8 bits in the header information of a frame. The initial value of DPCM for Huffman model information is set to 0.

Figure 8:
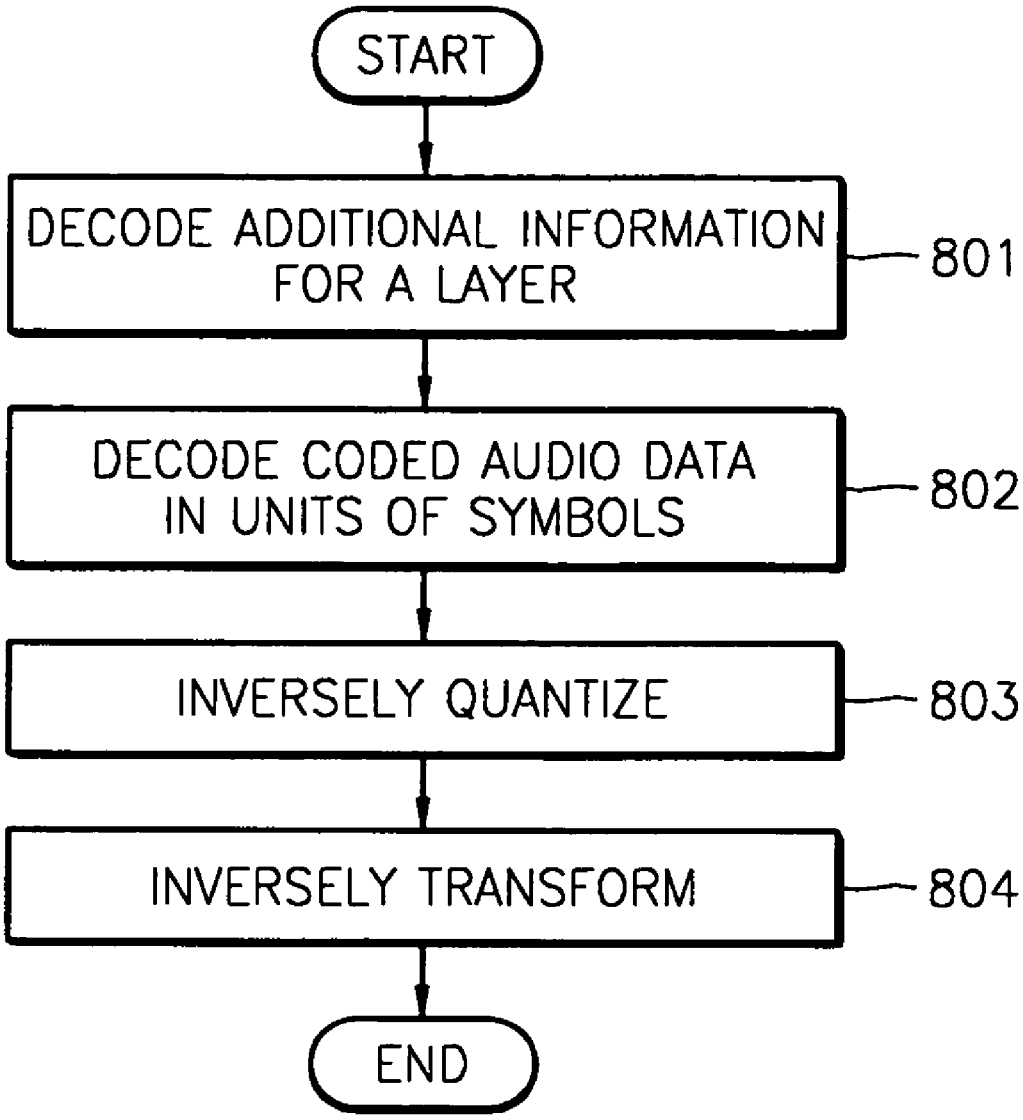
FIG. 8 is a flowchart for explaining a decoding method according to a preferred embodiment of the present invention.

FIG. 8 is a flowchart for explaining a decoding method according to a preferred embodiment of the present invention.

Referring to FIG. 8, the decoding apparatus receives a bitstream formed with audio data that is coded in a layered structure, and decodes header information in each frame. Then, additional information, including scale factor information and coding model information corresponding to a first layer, is decoded in step 801. Referring to the coding model information, quantized samples are obtained by decoding the bitstream in units of symbols in order from a symbol formed with msb bits down to a symbol formed with LSB bits in step 802. The obtained quantized samples are inversely quantized by referring to the scale factor information in step 803, and the inversely quantized samples are inverse-transformed in step 804. Steps 801 through 804 are repeatedly performed until decoding up to a predetermined target layer is finished with increasing the ordinal number added to each layer one by one every time.

Figure 9:
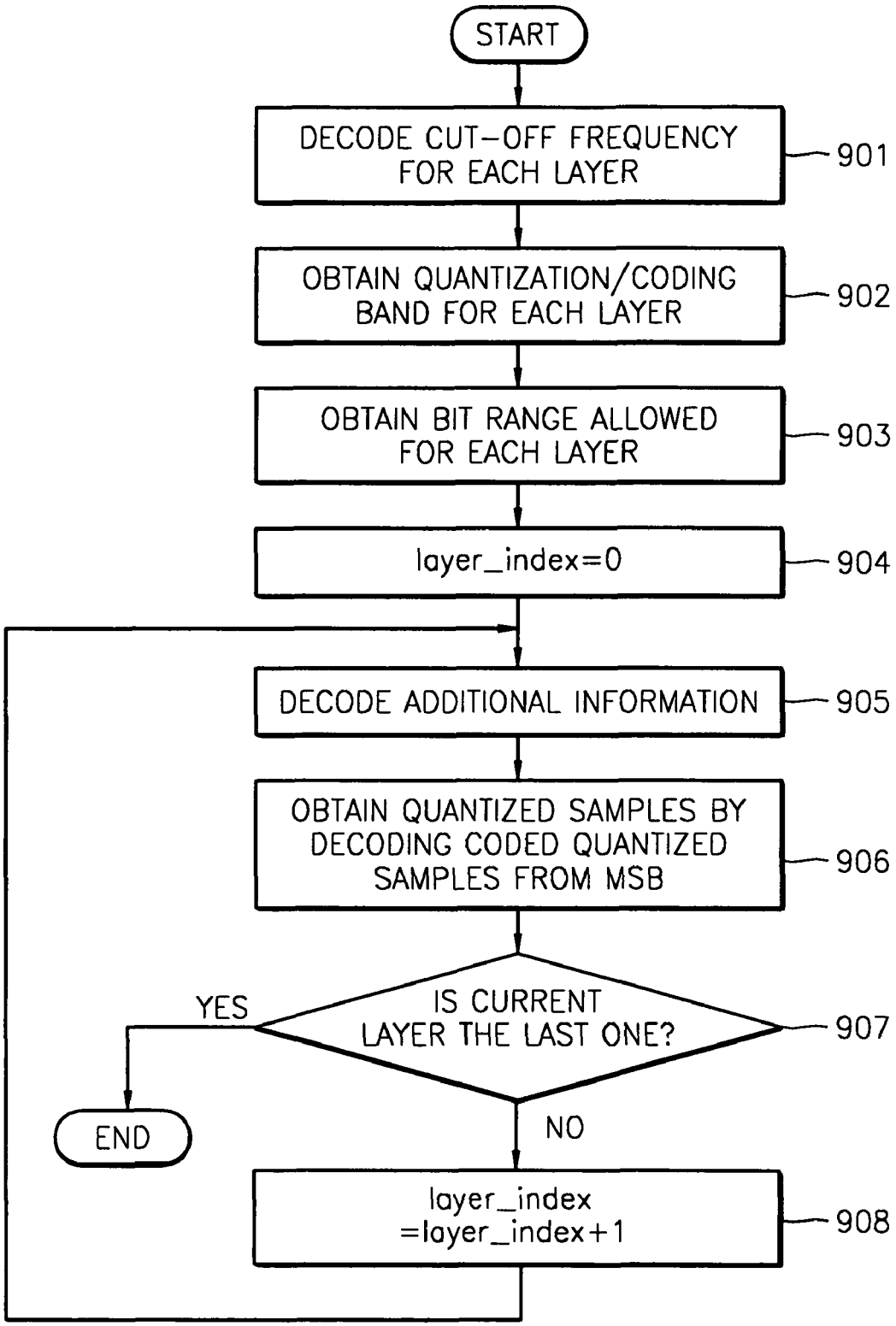
FIG. 9 is a flowchart for explaining a decoding method according to another preferred embodiment of the present invention.

FIG. 9 is a flowchart for explaining a decoding method according to another preferred embodiment of the present invention.

Referring to FIG. 9, a bitstream formed with audio data that is coded in a layered structure is received, and a cut-off frequency corresponding to each layer is decoded from header information in each frame, in step 901. In step 902, quantization band information and coding band information corresponding to each layer are identified from the header information by decoding. In step 903, an allowed bit range to be used for each layer is identified. In step 904, a layer index is set as a base layer. Additional information on the base layer is decoded in step 905, and quantized samples are obtained by decoding the bitstream in units of symbols to the bit range allowed in each layer, in order from a symbol formed with msb bits down to a symbol formed with LSB bits in step 906. In step 907, it is checked whether the current layer is the last one. Steps 905 and 906 are repeatedly performed on layers until a predetermined target layer is reached with increasing the number of a layer one by one. In steps 901 through 903, the decoding apparatus may have in advance the cut-off frequency, quantization band information, coding band information and bit range, rather than obtaining these pieces of information from header information stored in each frame of the received bitstream. In this case, the decoding apparatus obtains the information by reading the stored information.

According to the present invention as described above, by coding the bits in units of symbols after performing the bit slicing, scalability with which a bitrate can be controlled in a top-down manner is provided such that the amount of computation by the coding apparatus is not much greater than that of an apparatus that does not provide scalability. That is, according to the present invention, there are provided a method and apparatus for coding/decoding audio data with scalability in which complexity is lower, while providing FGS, can be provided even in a lower layer.

In addition, compared to the MPEG-4 Audio BSAC technique using the arithmetic coding, the coding/encoding apparatus of the present invention using the Huffman coding reduces the amount of computation in the processes for bit packing/unpacking, down to one eighth that of the BSAC technique. Even when bit packing according to the present invention is performed in order to provide the FGS, the overhead is small such that the coding gain is similar to that when scalability is not provided.

Also, since the apparatus according to the present invention has a layered structure, the process for regenerate a bitstream so that a server side can control the bitrate is very simple, and accordingly, the complexity of an apparatus for transformation coding is low.

When an audio stream is transmitted through a network, a transmission bitrate can be controlled according to the user's selection or the network conditions such that ceaseless services can be provided.

Further, when the audio stream is stored in an information storage medium having a limited capacity, the size of a file can be controlled arbitrarily and stored. If a bitrate becomes low, the band is restricted. Accordingly, the complexity of a filter which accounts for most of the complexity of a coding/decoding apparatus decreases greatly, and the actual complexity of the coding/decoding apparatus decreases in inverse proportion to the bitrate.

What is claimed is:

1. A coding method comprising:

using at least one processor for:

inputting audio signal and extracting audio data from said audio signal;

slicing the audio data so that sliced audio data corresponds to a plurality of layers;

obtaining scale band information defining a scale factor for each of a plurality of scale frequency bands and coding band information defining a coding model for a plurality of coding frequency bands, the scale frequency bands and coding frequency bands corresponding to each of the plurality of layers;

coding additional information containing scale factor information and coding model information based on scale band information and coding band information corresponding to a first layer;

obtaining quantized samples by quantizing audio data corresponding to the first layer with reference to the scale factor information;

Huffman-coding the obtained plurality of quantized samples in units of symbols in order from a symbol formed with most significant bits (MSB) down to a symbol formed with least significant bits (LSB) by referring to the coding model information; and repeatedly performing the steps with increasing the ordinal number of the layer one by one every time, until coding for the plurality of layers is finished, wherein the Huffman-coding of the plurality of the quantized samples comprises:

mapping a plurality of K quantized samples on a bit plane where K is an integer; and coding the K quantized samples in units of K-bit sized symbols in consideration of a bit range allowed in each of the plurality of layers corresponding to the samples in order from a symbol formed with MSB bits down to a symbol formed with LSB bits by obtaining a scalar value corresponding to the symbol, and performing Huffman-coding by referring to the K-bit binary data, the obtained scalar value, and a scalar value corresponding to a symbol higher than a current symbol on the bit plane.

2. The method of claim 1, further comprising, before the coding of additional information, obtaining a bit range allowed in each of the plurality of layers, wherein in the coding of the obtained plurality of quantized samples, the number of coded bits is counted, and if the number of counted bits exceeds a bit range corresponding to the bits, coding is stopped, and if the number of counted bits is less than the bit range corresponding to the bits even after quantized samples are all coded, bits that remain not coded after coding in a lower layer is finished are coded to the extent that the bit range permits.

3. The method of claim 1, wherein the slicing of audio data comprises:

performing a wavelet transform of audio data; and slicing the wavelet-transformed data by referring to a cut-off frequency so that the sliced data corresponds to the plurality of layers.

4. An apparatus, including at least one processing device, for coding audio data with scalability comprising:

a transformation unit using the at least one processing device which MDCT transforms the audio data;

a quantization unit which quantizes the MDCT-transformed audio data corresponding to each of a plurality of layers, by referring to the scale factor information, and outputs quantized samples; and a packing unit which differential-codes additional information containing scale factor information defining a scale factor for each of a plurality of scale frequency bands and coding model information defining a coding model for a plurality of coding frequency bands, the scale frequency bands and coding frequency bands corresponding to each of the plurality of layers, and Huffman-codes the plurality of quantized samples from the quantization unit, in units of symbols in order from a symbol formed with most significant bits (MSB) down to a symbol formed with least significant bits (LSB) by referring to the coding model information, wherein the packing unit maps a plurality of K quantized samples on a bit plane where K is an integer, codes the K quantized samples in units of K-bit sized symbols in consideration of a bit range allowed in each of the plurality of layers corresponding to the samples in order from a symbol formed with MSB bits down to a symbol formed with LSB bits by obtaining a scalar value corresponding to the symbol formed with K-bit binary data, and performs Huffman-coding by referring to the K-bit binary data, the obtained scalar value, and a scalar value corresponding to a symbol higher than a current symbol on the bit plane.

5. The apparatus of claim 4, wherein the packing unit obtains scale band information and coding band information corresponding to each of the plurality of layers, and codes additional information containing scale factor information and coding model information based on scale band information and coding band information corresponding to each layer.

6. The apparatus of claim 4, wherein the packing unit counts the number of coded bits and if the number of counted bits exceeds a bit range corresponding to the bits, stops the coding, and if the number of counted bits is less than the bit range corresponding to the bits even after quantized samples are all coded, codes bits that remain not coded after coding in a lower layer is finished, to the extent that the bit range permits.

7. The apparatus of claim 4, wherein the packing unit slices the MDCT-transformed data by referring to a cut-off frequency so that the sliced data corresponds to the plurality of layers.

* * * * *